US009103170B2

(12) United States Patent
Durairajan et al.

(10) Patent No.: US 9,103,170 B2
(45) Date of Patent: Aug. 11, 2015

(54) IMPREGNATED DRILL BIT

(75) Inventors: Bala Durairajan, Houston, TX (US); Jonan Fulenchek, Tomball, TX (US); Gregory T. Lockwood, Pearland, TX (US)

(73) Assignee: Smith International, Inc., Houston, TX (US)

( * ) Notice: Subject to any disclaimer, the term of this patent is extended or adjusted under 35 U.S.C. 154(b) by 271 days.

(21) Appl. No.: 12/122,467

(22) Filed: May 16, 2008

(65) Prior Publication Data

US 2009/0283334 A1 Nov. 19, 2009

(51) Int. Cl.

| | |
|---|---|
| ***E21B 10/00*** | (2006.01) |
| ***E21B 10/46*** | (2006.01) |
| ***E21B 10/54*** | (2006.01) |
| ***E21B 10/60*** | (2006.01) |

(52) U.S. Cl.
CPC ..... *E21B 10/46* (2013.01); *E21B 10/54* (2013.01); *E21B 10/602* (2013.01)

(58) Field of Classification Search
USPC ..... 166/398, 327; 76/108.2, 108.4; 175/398, 327, 413, 425
See application file for complete search history.

(56) References Cited

U.S. PATENT DOCUMENTS

| | | | | |
|---|---|---|---|---|
| 1,471,526 | A * | 10/1923 | Pickin | 175/379 |
| 3,298,451 | A * | 1/1967 | Eckel et al. | 175/393 |
| 4,098,363 | A * | 7/1978 | Rohde et al. | 175/391 |
| 4,723,996 | A | 2/1988 | Brunet et al. | |
| 4,771,834 | A * | 9/1988 | Treitz | 175/415 |
| 4,813,500 | A * | 3/1989 | Jones | 175/379 |
| RE33,757 | E | 12/1991 | Weaver | |
| 5,089,182 | A | 2/1992 | Findeisen et al. | |
| 5,103,922 | A * | 4/1992 | Jones | 175/429 |
| 5,816,347 | A | 10/1998 | Dennis et al. | |
| 6,009,962 | A | 1/2000 | Beaton | |
| 6,287,360 | B1 * | 9/2001 | Kembaiyan et al. | 75/240 |
| 6,394,202 | B2 | 5/2002 | Truax et al. | |
| 6,533,052 | B2 | 3/2003 | Wentworth et al. | |
| 7,426,969 | B2 * | 9/2008 | Azar | 175/426 |
| 7,798,256 | B2 * | 9/2010 | Hoffmaster et al. | 175/408 |
| 7,866,419 | B2 | 1/2011 | Lockwood | |
| 8,100,203 | B2 | 1/2012 | Lockwood et al. | |
| 8,517,125 | B2 | 8/2013 | Lockwood | |
| 2003/0037964 | A1 | 2/2003 | Sinor et al. | |
| 2004/0154840 | A1 * | 8/2004 | Azar et al. | 175/434 |
| 2006/0081402 | A1 | 4/2006 | Lockwood et al. | |
| 2007/0205023 | A1 | 9/2007 | Hoffmaster et al. | |
| 2007/0240904 | A1 * | 10/2007 | Stauffer et al. | 175/51 |
| 2008/0149398 | A1 | 6/2008 | Azar | |

(Continued)

FOREIGN PATENT DOCUMENTS

| | | |
|---|---|---|
| GB | 2472158 | 1/2011 |

OTHER PUBLICATIONS

International Search Report and Written Opinion dated Dec. 28, 2009 for corresponding PCT Application No. PCT/US2009/043060 filed May 7, 2009.

(Continued)

*Primary Examiner* — James G Sayre

(57) ABSTRACT

A drill bit that includes a body having a lower end face for engaging a rock formation. The end face having a plurality of raised ribs extending from the face of the bit body and separated by a plurality of channels therebetween At least one of the plurality of ribs has a varying width along at least a portion of a rib height.

34 Claims, 9 Drawing Sheets

(56) References Cited

U.S. PATENT DOCUMENTS

| | | | | |
|---|---|---|---|---|
| 2008/0230278 | A9* | 9/2008 | Hoffmaster et al. | 175/408 |
| 2009/0062670 | A1 | 3/2009 | Sterling et al. | |
| 2009/0120008 | A1 | 5/2009 | Lockwood et al. | |
| 2009/0223721 | A1* | 9/2009 | Dourfaye | 175/426 |
| 2009/0283335 | A1 | 11/2009 | Lockwood et al. | |

OTHER PUBLICATIONS

Examination Report of British Patent Application No. GB1016321.0 dated Mar. 28, 2012: pp. 1-3.

* cited by examiner

IMPREGNATED DRILL BIT

BACKGROUND OF INVENTION

1. Field of the Invention

Embodiments disclosed herein relate generally to drill bits, and more particularly to drill bits having impregnated cutting surfaces and the methods for the manufacture of such drill bits.

2. Background Art

An earth-boring drill bit is typically mounted on the lower end of a drill string and is rotated by rotating the drill string at the surface or by actuation of downhole motors or turbines, or by both methods. When weight is applied to the drill string, the rotating drill bit engages the earth formation and proceeds to form a borehole along a predetermined path toward a target zone.

Different types of bits work more efficiently against different formation hardnesses. For example, bits containing inserts that are designed to shear the formation frequently drill formations that range from soft to medium hard. These inserts often have polycrystalline diamond compacts (PDC's) as their cutting faces.

Roller cone bits are efficient and effective for drilling through formation materials that are of medium to hard hardness. The mechanism for drilling with a roller cone bit is primarily a crushing and gouging action, in which the inserts of the rotating cones are impacted against the formation material. This action compresses the material beyond its compressive strength and allows the bit to cut through the formation.

For still harder materials, the mechanism for drilling changes from shearing to abrasion. For abrasive drilling, bits having fixed, abrasive elements are preferred. While bits having abrasive polycrystalline diamond cutting elements are known to be effective in some formations, they have been found to be less effective for hard, very abrasive formations such as sandstone. For these hard formations, cutting structures that comprise particulate diamond, or diamond grit, impregnated in a supporting matrix are effective. In the discussion that follows, components of this type are referred to as "diamond impregnated."

Diamond impregnated drill bits are commonly used for boring holes in very hard or abrasive rock formations. The cutting face of such bits contains natural or synthetic diamonds distributed within a supporting material to form an abrasive layer. During operation of the drill bit, diamonds within the abrasive layer are gradually exposed as the supporting material is worn away. The continuous exposure of new diamonds by wear of the supporting material on the cutting face is the fundamental functional principle for impregnated drill bits.

The construction of the abrasive layer is of critical importance to the performance of diamond impregnated drill bits. The abrasive layer typically contains diamonds and/or other super-hard materials distributed within a suitable supporting material. The supporting material must have specifically controlled physical and mechanical properties in order to expose diamonds at the proper rate.

Metal-matrix composites are commonly used for the supporting material because the specific properties can be controlled by modifying the processing or components. The metal-matrix usually combines a hard particulate phase with a ductile metallic phase. The hard phase often consists of tungsten carbide and other refractory or ceramic compounds. Copper or other nonferrous alloys are typically used for the metallic binder phase. Common powder metallurgical methods, such as hot-pressing, sintering, and infiltration are used to form the components of the supporting material into a metal-matrix composite. Specific changes in the quantities of the components and the subsequent processing allow control of the hardness, toughness, erosion and abrasion resistance, and other properties of the matrix.

Proper movement of fluid used to remove the rock cuttings and cool the exposed diamonds is important for the proper function and performance of diamond impregnated bits. The cutting face of a diamond impregnated bit typically includes an arrangement of recessed fluid paths intended to promote uniform flow from a central plenum to the periphery of the bit. The fluid paths usually divide the abrasive layer into distinct raised ribs with diamonds exposed on the tops of the ribs. The fluid provides cooling for the exposed diamonds and forms a slurry with the rock cuttings. The slurry must travel across the top of the rib before reentering the fluid paths, which contributes to wear of the supporting material.

An example of a prior art diamond impregnated drill bit is shown in FIG. 1. The impregnated bit 10 includes a bit body 12 and a plurality of ribs 14 that are formed in the bit body 12. The ribs 14 are separated by channels 16 that enable drilling fluid to flow between and both clean and cool the ribs 14. The ribs 14 are typically arranged in groups 20 where a gap 18 between groups 20 is typically formed by removing or omitting at least a portion of a rib 14. The gaps 18, which may be referred to as "fluid courses," are positioned to provide additional flow channels for drilling fluid and to provide a passage for formation cuttings to travel past the drill bit 10 toward the surface of a wellbore (not shown).

Impregnated bits are typically made from a solid body of matrix material formed by any one of a number of powder metallurgy processes known in the art. During the powder metallurgy process, abrasive particles and a matrix powder are infiltrated with a molten binder material. Upon cooling, the bit body includes the binder material, matrix material, and the abrasive particles suspended both near and on the surface of the drill bit. The abrasive particles typically include small particles of natural or synthetic diamond. Synthetic diamond used in diamond impregnated drill bits is typically in the form of single crystals. However, thermally stable polycrystalline diamond (TSP) particles may also be used.

In one impregnated bit forming process, the shank of the bit is supported in its proper position in the mold cavity along with any other necessary formers, e.g. those used to form holes to receive fluid nozzles. The remainder of the cavity is filled with a charge of tungsten carbide powder. Finally, a binder, and more specifically an infiltrant, typically a nickel brass copper based alloy, is placed on top of the charge of powder. The mold is then heated sufficiently to melt the infiltrant and held at an elevated temperature for a sufficient period to allow it to flow into and bind the powder matrix or matrix and segments. For example, the bit body may be held at an elevated temperature (>1800° F.) for a period on the order of 0.75 to 2.5 hours, depending on the size of the bit body, during the infiltration process.

By this process, a monolithic bit body that incorporates the desired components is formed. One method for forming such a bit structure is disclosed in U.S. Pat. No. 6,394,202 (the '202 patent), which is assigned to the assignee of the present invention and is hereby incorporated by reference.

Referring now to FIG. 2, a drill bit 22 in accordance with the '202 patent comprises a shank 24 and a crown 26. Shank 24 is typically formed of steel and includes a threaded pin 28 for attachment to a drill string. Crown 26 has a cutting face 29 and outer side surface 30. According to one embodiment, crown 26 is formed by infiltrating a mass of tungsten-carbide powder impregnated with synthetic or natural diamond, as described above.

Crown 26 may include various surface features, such as raised ridges 32. Preferably, formers are included during the manufacturing process so that the infiltrated, diamond-impregnated crown includes a plurality of holes or sockets 34 that are sized and shaped to receive a corresponding plurality of diamond-impregnated inserts 36. Once crown 26 is formed, inserts 36 are mounted in the sockets 34 and affixed by any suitable method, such as brazing, adhesive, mechanical means such as interference fit, or the like. As shown in FIG. 2, the sockets can each be substantially perpendicular to the surface of the crown. Alternatively, and as shown in FIG. 2, holes 34 can be inclined with respect to the surface of the crown 26. In this embodiment, the sockets are inclined such that inserts 36 are oriented substantially in the direction of rotation of the bit, so as to enhance cutting.

With respect to the diamond material to be incorporated (either as an insert, or on the bit, or both), diamond granules are formed by mixing diamonds with matrix power and binder into a paste. The paste is then extruded into short "sausages" that are rolled and dried into irregular granules. The process for making diamond-impregnated matrix for bit bodies involves hand mixing of matrix powder with diamonds and a binder to make a paste. The paste is then packed into the desired areas of a mold. The resultant irregular diamond distribution has clusters with too many diamonds, while other areas are void of diamonds. The diamond clusters lack sufficient matrix material around them for good diamond retention. The areas void or low in diamond concentration have poor wear properties. Accordingly, the bit or insert may fail prematurely, due to uneven wear. As the motors or turbines powering the bit improve (higher sustained RPM), and as the drilling conditions become more demanding, the durability of diamond-impregnated bits needs to improve. However, generally, as durability of a bit increases (with a harder matrix), diamond exposure (and thus ROP) generally decreases, and vice versa.

Accordingly, there exists a continuing need for improvements in diamond impregnated bit so that rate of penetration may be increased without sacrificing durability.

SUMMARY OF INVENTION

In one aspect, embodiments disclosed herein relate to a drill bit that includes a body having a lower end face for engaging a rock formation, the end face having a plurality of raised ribs extending from the face of the bit body and separated by a plurality of channels therebetween; at least one of the plurality of ribs having a varying width along at least a portion of a rib height.

In another aspect, embodiments disclosed herein relate to a drill bit that includes a body having a lower end face for engaging a rock formation, the end face having a plurality of raised ribs extending from the face of the bit body and separated by a plurality of channels therebetween; at least one of the plurality of ribs having incremental decreases in width from a base of the rib along its height.

In yet another aspect, embodiments disclosed herein relate to a drill bit that includes a body having a lower end face for engaging a rock formation, the end face having a plurality of raised ribs extending from the face of the bit body and separated by a plurality of channels therebetween; at least one of the plurality of ribs having a gradual decrease in width from a base of the rib along its height.

Other aspects and advantages of the invention will be apparent from the following description and the appended claims.

BRIEF DESCRIPTION OF DRAWINGS

FIG. 31B shows a side view of a rib on the bit of FIG. 3A

DETAILED DESCRIPTION

Embodiments disclosed herein relate to impregnated drill bits and methods of manufacturing and using the same. Specifically, embodiments disclosed herein relate to impregnated drill bits with at least one rib designed to have a varying width. More specifically, embodiments disclosed herein relate to impregnated drill bits with at least one rib having a graded or stepped cross-sectional profile.

Figure 1:
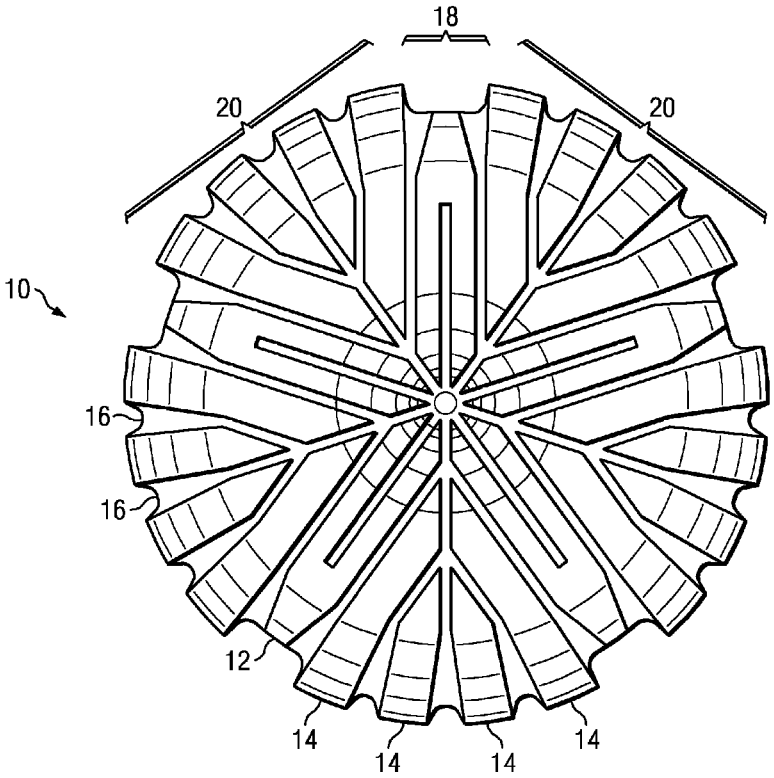
FIG. 1 (PRIOR ART)
FIG. 1 is a prior art impregnated bit.
Figure 1A:
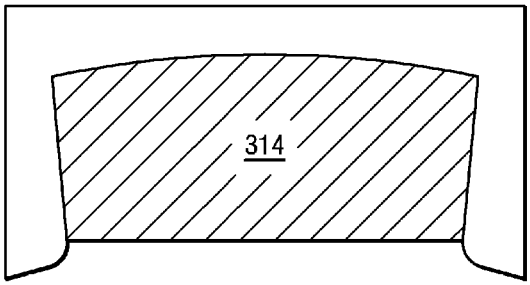
FIG. 1A shows a cross-section view of a rib of the bit shown in FIG. 1.
Figure 2:
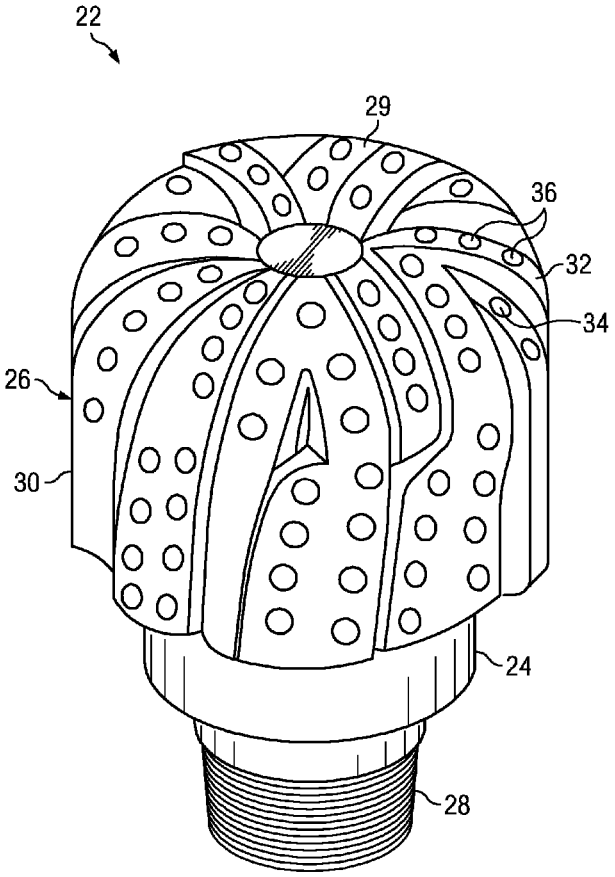
FIG. 2 (PRIOR ART)
FIG. 2 is a prior art impregnated bit.
Figure 3A:
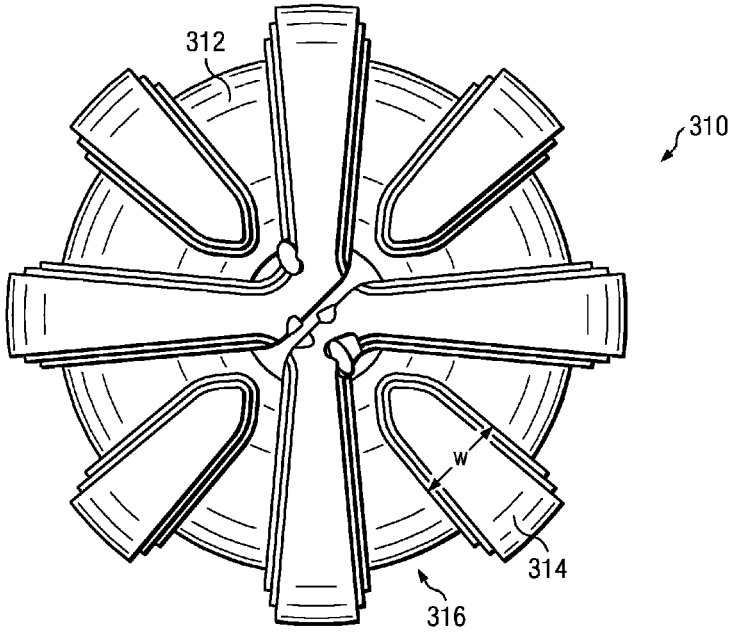
FIG. 3A shows a top view of a drill bit in accordance with one embodiment of the present disclosure.
Figure 3B:
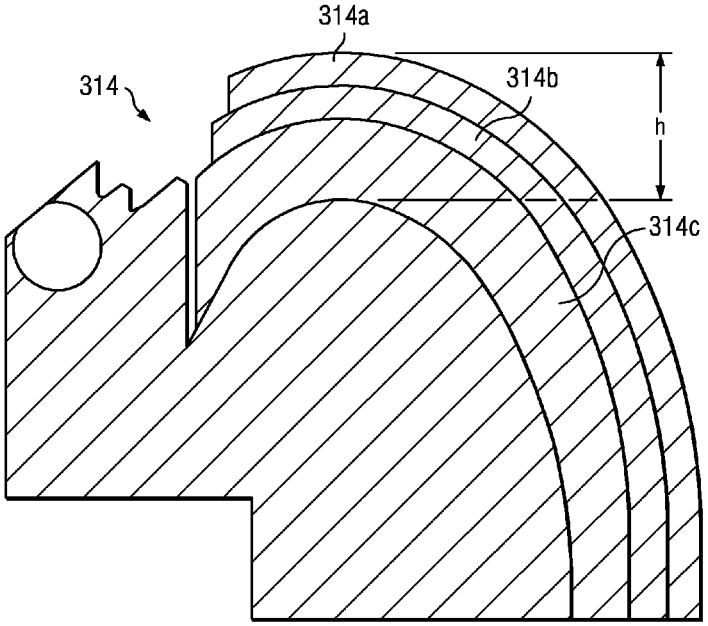
FIG. 3C shows a cross-sectional view of a rib on the bit of FIG. 3A
FIG. 3D shows a close-up view of the bit of FIG. 3A.
Figure 3C:
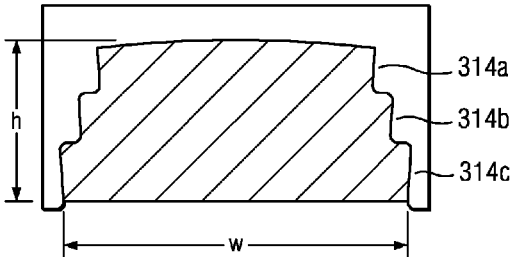

Referring to FIGS. 3A-C, a top view of a drill bit, and a side and cross-sectional view of a rib of the drill bit in FIG. 3A is shown. As shown in FIGS. 3A-C, a bit 310 includes a bit body 312 and a plurality of impregnated ribs 314 that are formed in the bit body 312. The ribs 314 are separated by channels 316 that enable drilling fluid to flow between and both clean and cool the ribs 314. At least one rib 314 possesses a varying width. As illustrated, rib 314 posses a varying width (w) along its height (h). Specifically, rib 314 may be divided into three steps 314*a*, 314*b*, and 314*c*, where each step has a constant width, and where comparing the steps 314*a*, 314*b*, and 314*e* to each other, the width of each step decreases step-wise with an increased distance from bit body 312. That is, step 314*a* has the narrowest width, with steps 314*b* and 314*c* being incrementally wider. Further, one skilled in the art would appreciate that the incremental width differential may depend, for example, on the size of the particular bit, the number of ribs on the bit, etc. However, in a particular embodiment, the width differential between steps may range from 0.05 inches to 0.75 inches.

Figure 3D:
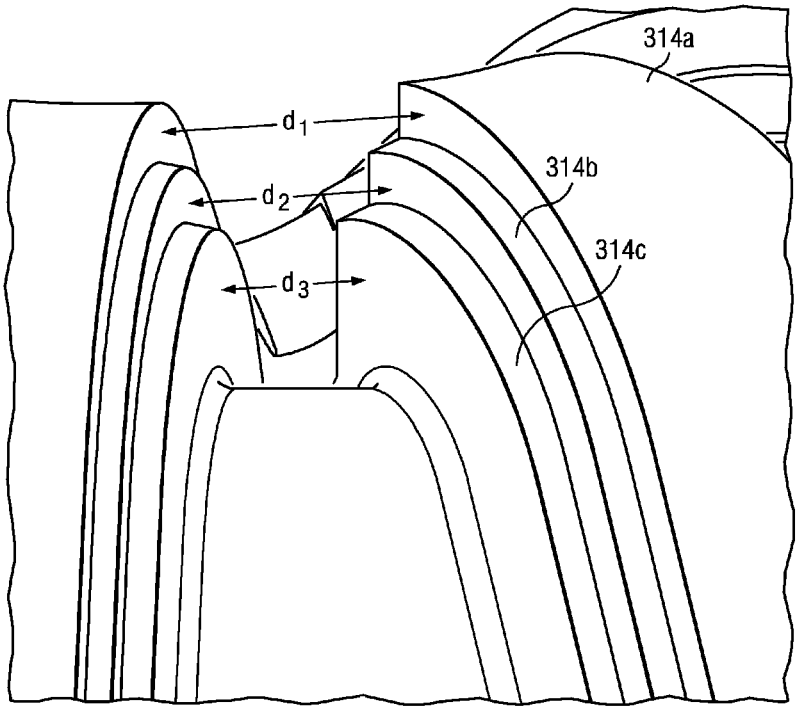

Thus, referring to FIG. 3D, showing a close-up view of the bit 310 of FIG. 3A, when a bit 310 is manufactured with all ribs 314 having steps 314*a*, 314*b*, and 314*c*, the variation in the width of each step distances indicates a variation in the distance (d) (or waterway width) between the ribs. For example, a greater distance $d_1$ exists between steps 314*a* than distance $d_2$ between steps 314*b*, which is greater than the distance $d_3$ between steps 314*c*. Thus, in drilling with such a bit 310, the bit 310 contacts the formation and drills with narrower steps 314*a* of ribs 314. The narrowness of steps 314*a* allows for less contact area on the formation being drilled, and coupled with a greater waterway width $d_1$ to allow for a more open bit for escape of drilled cuttings, the bit may observe a high initial rate of penetration (ROP). As the bit 310 drills and wears, the contact area of the bit 310 increases from the top to the bottom of the rib, as the second step 314*b* (and then third step 314*c*) begin to drill, providing increased bit durability.

Figure 4A:
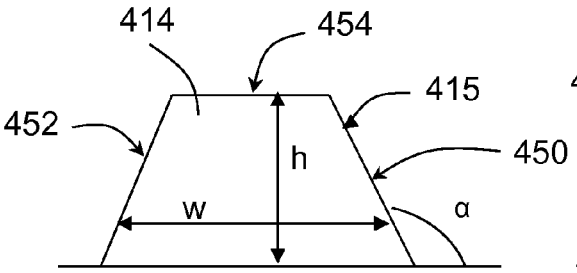
FIGS. 4A and 4B show cross-sectional views of ribs in accordance with embodiments of the present disclosure.
Figure 4B:
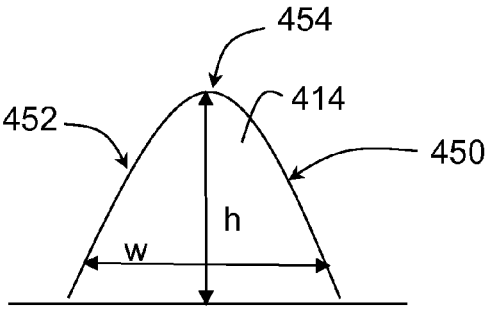
Figure 5A:
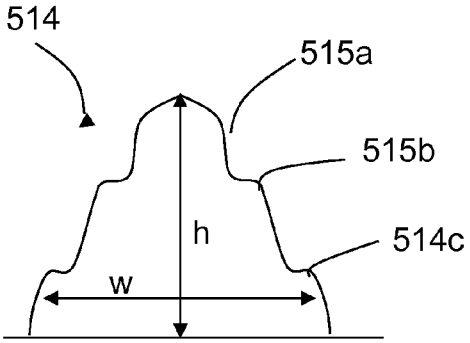
FIGS. 5A-5B show cross-sectional views of ribs in accordance with embodiments of the present disclosure.
Figure 5B:
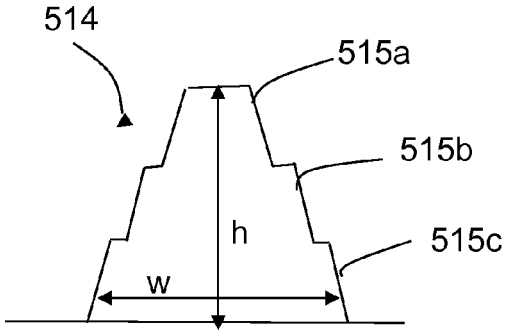

However, while FIGS. 3A-C show a "stepped" variation in the width of a rib, the present invention is not so limited. Rather, referring to FIGS. 4A-B, other embodiments of the present disclosure are shown. As shown in FIGS. 4A-B, a rib 414 may include a cross-sectional profile that has a graded or sloped variation in its width, as compared to the step-wise or incremental variation shown in FIGS. 3A-D. Thus, the width of rib 414 varies gradually with its height. As shown, the width w of rib 414 is measured between a leading surface 450 and a trailing surface 452 of the rib, wherein the leading surface 450 faces in the direction of bit rotation and the trailing surface 452 faces in a direction away from bit rotation. A height h is measured from the base of the rib 414 to a top surface 454 of the rib 414. As illustrated in FIG. 4A, the cross-sectional geometric profile of rib 414 is generally trapezoidal, with its width varying at a constant rate. Such width variance may be correlated by the angle, $\alpha$, between the base and the sloped side 415 of rib 414, which may generally be greater than 90°. In a particular embodiment, angle, $\alpha$, may range from about 95° to 135°. Further, as illustrated in FIG. 4B, the cross-sectional geometric profile of rib 414 may alternatively be parabolic. Thus, the particular cross-sectional geometric profile is not intended to be a limitation on the scope of the present disclosure. Rather, a rib having a cross-sectional profile of any geometric configuration may be used Referring to FIGS. 5A-B, yet other embodiments of the present disclosure are shown. As shown in FIGS. 5A-B, a combination of a stepped and graded or sloped width variation may be used. Specifically, FIG. 5A is illustrated as having three steps, 515*a*, 515*b*, and 515*c*, having incremental width changes, with each step 515*a*, 515*b*, and 515*c* also having a gradual variation in its width. Similar to FIGS. 4A-B, the ribs 514 (and each step) illustrated in FIGS. 5A-B may have a variety of geometric configurations, including trapezoidal, parabolic, etc.

Figure 6:
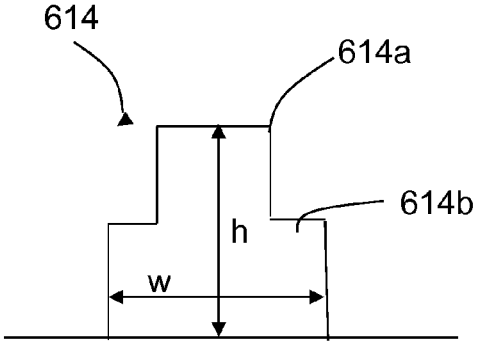
FIG. 6 shows a cross-sectional view of a rib in accordance with one embodiment of the present disclosure.

Further, while each of the "stepped" ribs is illustrated as having three incremental, no limitation is intended on the scope of the present disclosure. As shown in FIG. 6, a rib 614 having two steps 614*a*, 614*b* such that the width of rib 614 varies with along the height of the rib 614 is shown. Additionally, any other number of steps (e.g., greater than 3) may also be used in any of the variously embodiments disclosed herein.

Figure 7A:
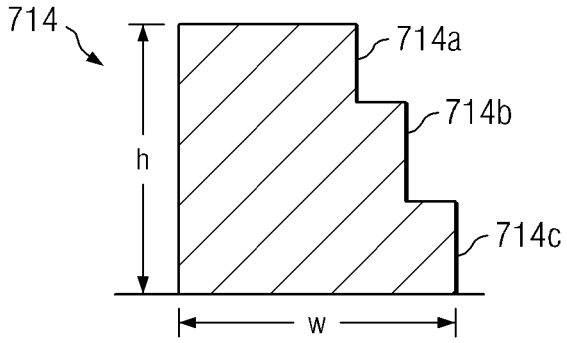
FIGS. 7A and 7B show cross-sectional views of ribs in accordance with embodiments of the present disclosure.
Figure 7B:
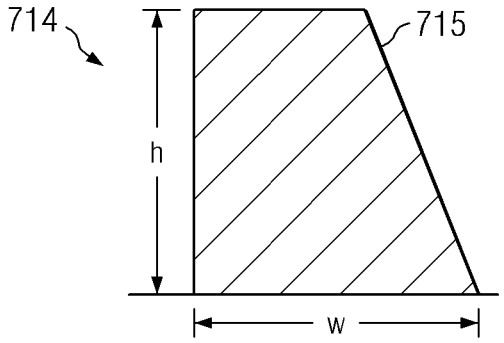

Additionally, while each of the "stepped" or "graded" ribs discussed above is symmetrical with respect to a vertical centerline of the rib, the present disclosure is not so limited. For example, as shown in FIGS. 7A and 7B, ribs 714 may be graded (715) or stepped (with steps 714*a*, 714*b*, and 714*c*) on either the leading (facing the direction in which the bit rotates) or trailing (not facing the direction in which the bit rotates) edge of the rib 714. In a particular embodiment, the trailing edge of the rib may be stepped or graded to allow for better cuttings removal.

Figure 8A:
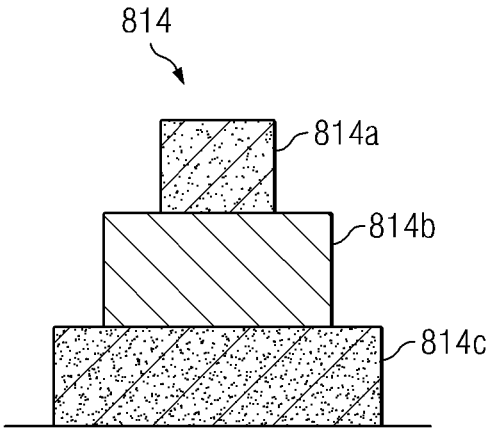
FIGS. 8A and 8B show cross-sectional views of ribs in accordance with embodiments of the present disclosure.
Figure 8B:
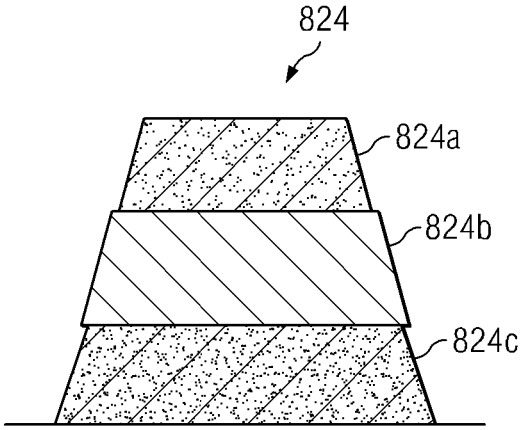

In addition to possessing a varying width, another aspect of the present disclosure may provide for a variation in the material components within a rib. For example, referring to FIG. 8A, a stepped rib 814 includes steps 814*a*, 814*b*, and 814*c* (similar to bit 310 described above). However, as shown in FIG. 8A, steps 814*a*, 814*b*, and 814*c* are all formed of different materials. Further, as shown in FIG. 8B, a graded rib 824 may be segmented into multiple layers 824*a*, 824*b*, and 824*c*, which may be formed of different materials.

Figure 9:
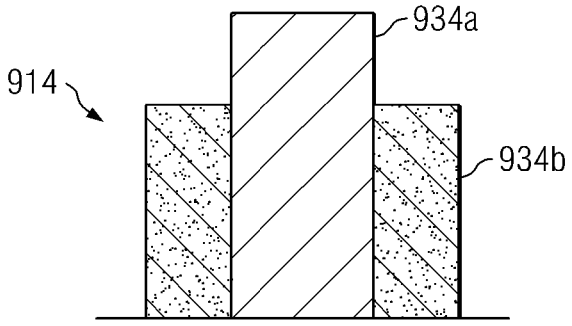
FIG. 9 shows a cross-sectional view of a rib in accordance with embodiments of the present disclosure.

Additionally, referring to FIG. 9, a rib 914 may be segmented vertically, such that a center segment 934*a* may have a greater height than neighboring segments 934*b*, such that the width of rib 917 varies along its height. It is also within the scope of the present disclosure that such vertical segments 934*a* and 934*b* may be formed of different materials. In such an embodiment, in drilling with a bit (not shown separately) having such a rib 914, the bit contacts the formation and drills with vertical segment 934*a* of ribs 314. The narrowness of segment 934*a* allows for less contact area on the formation being drilled, and coupled with a greater escape route of drilled cuttings, the bit may observe a high initial rate of penetration (ROP). As the bit drills and wears, the contact area of the bit increases from the top to the bottom of the rib to include segment 934*a* and 934*b*, providing increased bit durability. However, by using different materials between the segments, the increased contact area may be balanced by a rib that then wears in situ to have a tapered surface. Formation of a tapered surface in situ is discussed in greater detail in U.S. patent application Ser. No. 12/122,526, filed concurrently herewith, which is assigned to the present assignee and herein incorporated by reference in its entirety. Further, although FIG. 9 illustrates a rib having a total of three vertical segments, one of ordinary skill in the art would appreciate that the number of vertical segments may vary, and may include an even or an odd number of segments (with any number of incremental width differentials) and may be symmetric or asymmetric about a vertical centerline extending along the rib.

For example, the various segments or steps of a rib may be formed from various combinations of matrix material impregnated with super abrasive particles. Further, in a particular embodiment, the different segments or steps may be formed of materials to result in a hardness difference of at least 7 HRC and up to 50 HRC between two neighboring segments or steps of the rib. However, in other embodiments, the segments or steps may be formed of the same materials, with no difference in material properties therebetween.

This difference between the materials between the segments or steps may include variations in chemical make-up or particle size ranges/distribution, which may translate, for example, into a difference in wear or erosion resistance properties of the rib portions. Thus, for example, different types of carbide (or other hard) particles may be used among the different types of matrix materials. One of ordinary skill in the art would appreciate that a particular variety of tungsten carbide, for example, may be selected based on hardness/wear resistance. Further, chemical make-up of a matrix powder material may also be varied by altering the percentages/ratios of the amount of hard particles as compared to binder powder. Thus, by decreasing the amount of tungsten carbide particle and increasing the amount of binder powder in a portion of the rib, a softer portion of the rib may be obtained, and vice versa. In a particular embodiment, the matrix materials may be selected so that a particular segment comprises a tougher, softer material.

Additionally, in various embodiments, the various segments may be formed of encapsulated particles to provide for impregnation described above. The use of encapsulated particles in cutting structures is described for example in U.S. Patent Publication No. 2006/0081402 and U.S. application Ser. Nos. 11/779,083, 11/779,104, and 11/937,969, all of which are assigned to the present assignee, and herein incorporated by reference in their entireties. Briefly, encapsulated particles are formed of super abrasive particles coated or surrounded by encapsulating shell of matrix powder material. The encapsulated particles may be infiltrated with an infiltrating material that may include an infiltration binder and an optional matrix powder material.

Super Abrasive Particles

The super abrasive particles may be selected from synthetic diamond, natural diamond, reclaimed natural or synthetic diamond grit, cubic boron nitride (CBN), thermally stable polycrystalline diamond (TSP), silicon carbide, aluminum oxide, tool steel, boron carbide, or combinations thereof. In various embodiments, the leading portion and trailing portion may be impregnated with particles selected to result in a more abrasive leading portion as compared to trailing portion (or vice versa). Thus, the impregnated particles may be selected to differ in type (i.e., chemical composition), quality (strength), size, concentration, and/or retention coatings, all of which may alter the resulting materials properties of the rib portions.

The shape of the abrasive particles may also be varied as abrasive particles may be in the shape of spheres, cubes, irregular shapes, or other shapes. In some embodiments, abrasive particles may range in size from 0.2 to 2.0 mm in length or diameter; from 0.3 to 1.5 mm in other embodiments; from 0.4 to 1.2 mm in other embodiments; and from 0.5 to 1.0 mm in yet other embodiments.

However, particle sizes are often measured in a range of mesh sizes, for example—40+80 mesh. The term "mesh" actually refers to the size of the wire mesh used to screen the particles. For example, "40 mesh" indicates a wire mesh screen with forty holes per linear inch, where the holes are defined by the crisscrossing strands of wire in the mesh. The hole size is determined by the number of meshes per inch and the wire size. The mesh sizes referred to herein are standard U.S. mesh sizes. For example, a standard 40 mesh screen has holes such that only particles having a dimension less than 420 μm can pass. Particles having a size larger than 420 μm are retained on a 40 mesh screen and particles smaller than 420 μm pass through the screen. Therefore, the range of sizes of the particles is defined by the largest and smallest grade of mesh used to screen the particles. Particles in the range of −16+40 mesh (i.e., particles are smaller than the 16 mesh screen but larger than the 40 mesh screen) will only contain particles larger than 420 μm and smaller than 1190 μm, whereas particles in the range of −40+80 mesh will only contain particles larger than 180 μm and smaller than 420 μm.

Thus, in some embodiments, abrasive particles may include particles not larger than would be filtered by a screen of 10 mesh. In other embodiments, abrasive particles may range in size from −15+35 mesh. In a particular embodiment, the leading portion may include abrasive particles ranging in size from −25+35 mesh, while the trailing portion may include abrasive particles ranging in size from −20+25 mesh. However, one of ordinary skill would recognize that the particle sizes and distribution of the particle sizes of the abrasive particles may be selected to allow for a broad, uniform, or bimodal distribution, for example, depending on a particular application, and that size ranges outside the distribution discussed above may also be selected. Further, although particle sizes or particle diameters are referred to, it is understood by those skilled in the art that the particles may not necessarily be spherical in shape.

Further, as discussed above, various abrasive particles that may be selected for use in the ribs may vary in type (i.e., chemical composition) such that the various portions of a rib may use different types of abrasive particles; however, one of ordinary skill in the art would appreciate that among these particles, there may also be a difference in compressive strength of the particles. For example, some synthetic diamond grit may have a greater compressive strength than natural diamond grit and/or reclaimed grit. Furthermore, even within the general synthetic grit type, there may exist different grades of grit having differing compressive strengths, such as those grades of grit commercially available from Element Six Ltd. (Berkshire, England). For example, recycled diamond grit (reduced strength due to multiple high temperature exposures) could be used as the abrasive particles within one segment so as to render that segment less wear resistant than a neighboring segment.

In addition to varying the strength of the abrasive particles, the presence and chemical identity of a retention coating on the surface of the abrasive particle may also optionally be varied. Such retention coatings may be applied by conventional techniques such as CVD or PVD. One of ordinary skill in the art would appreciate that the thin coatings (having a thickness of only a few micrometers) may be more helpful for high temperature protection (e.g., SiC coatings) while others are helpful for grit retention (e.g., TiC). In certain embodiments, the retention coating (TiC in the above example) may help bond the diamond to the "outer" matrix material in which the abrasive particles are impregnated. Additionally, in certain applications the retention coating may reduce thermal damage to the particles. For example, different coatings may be used between abrasive particles on the various rib portions, such as for example, a weaker PVD coating could be applied on the particles in a first segment of the rib, and a stronger CVD coating on abrasive particles in a second segment of the rib, leading to a less wear resistant first segment.

Matrix Material

The impregnated particles may be dispersed in a continuous matrix material formed from a matrix powder and infiltrating binder material. The matrix powder material may include a mixture of a carbide compounds and/or a metal alloy using any technique known to those skilled in the art. For example, matrix powder material may include at least one of macrocrystalline tungsten carbide particles, carburized tungsten carbide particles, cast tungsten carbide particles, and sintered tungsten carbide particles. In other embodiments non-tungsten carbides of vanadium, chromium, titanium, tantalum, niobium, and other carbides of the transition metal group may be used. In yet other embodiments, carbides, oxides, and nitrides of Group IVA, VA, or VIA metals may be used. Typically, a binder phase may be formed from a powder component and/or an infiltrating component. In some embodiments of the present invention, hard particles may be used in combination with a powder binder such as cobalt, nickel, iron, chromium, copper, molybdenum and their alloys, and combinations thereof. In various other embodiments, an infiltrating binder may include a Cu—Mn—Ni alloy, Ni—Cr—Si—B—Al—C alloy, Ni—Al alloy, and/or Cu—P alloy. In other embodiments, the infiltrating matrix material may include carbides in amounts ranging from 0 to 70% by weight in addition to at least one binder in amount ranging from 30 to 100% by weight thereof to facilitate bonding of matrix material and impregnated materials.

Further, with respect to particle sizes, each type of matrix material (for respective portions of a rib) may be individually be selected from particle sizes that may range in various embodiments, for example, from about 1 to 200 micrometers, from about 1 to 150 micrometers, from about 10 to 100 micrometers, and from about 5 to 75 micrometers in various other embodiments or may be less than 50, 10, or 3 microns in yet other embodiments. In a particular embodiment, each type of matrix material (for respective rib segments) may have a particle size distribution individually selected from a mono, bi- or otherwise multi-modal distribution.

Types of Tungsten Carbide

Tungsten carbide is a chemical compound containing both the transition metal tungsten and carbon. This material is known in the art to have extremely high hardness, high compressive strength and high wear resistance which makes it ideal for use in high stress applications. Its extreme hardness makes it useful in the manufacture of cutting tools, abrasives and bearings, as a cheaper and more heat-resistant alternative to diamond.

Sintered tungsten carbide, also known as cemented tungsten carbide, refers to a material formed by mixing particles of tungsten carbide, typically monotungsten carbide, and particles of cobalt or other iron group metal, and sintering the mixture. In a typical process for making sintered tungsten carbide, small tungsten carbide particles, e.g., 1-15 micrometers, and cobalt particles are vigorously mixed with a small amount of organic wax which serves as a temporary binder. An organic solvent may be used to promote uniform mixing. The mixture may be prepared for sintering by either of two techniques: it may be pressed into solid bodies often referred to as green compacts; alternatively, it may be formed into granules or pellets such as by pressing through a screen, or tumbling and then screened to obtain more or less uniform pellet size.

Such green compacts or pellets are then heated in a vacuum furnace to first evaporate the wax and then to a temperature near the melting point of cobalt (or the like) to cause the tungsten carbide particles to be bonded together by the metallic phase. After sintering, the compacts are crushed and screened for the desired particle size. Similarly, the sintered pellets, which tend to bond together during sintering, are crushed to break them apart. These are also screened to obtain a desired particle size. The crushed sintered carbide is generally more angular than the pellets, which tend to be rounded.

Cast tungsten carbide is another form of tungsten carbide and has approximately the eutectic composition between bitungsten carbide, $W_2C$, and monotungsten carbide, WC, Cast carbide is typically made by resistance heating tungsten in contact with carbon, and is available in two forms: crushed cast tungsten carbide and spherical cast tungsten carbide. Processes for producing spherical cast carbide particles are described in U.S. Pat. Nos. 4,723,996 and 5,089,182, which are herein incorporated by reference. Briefly, tungsten may be heated in a graphite crucible having a hole through which a resultant eutectic mixture of $W_2C$ and WC may drip. This liquid may be quenched in a bath of oil and may be subsequently comminuted or crushed to a desired particle size to form what is referred to as crushed cast tungsten carbide. Alternatively, a mixture of tungsten and carbon is heated above its melting point into a constantly flowing stream which is poured onto a rotating cooling surface, typically a water-cooled casting cone, pipe, or concave turntable. The molten stream is rapidly cooled on the rotating surface and forms spherical particles of eutectic tungsten carbide, which are referred to as spherical cast tungsten carbide.

The standard eutectic mixture of WC and $W_2C$ is typically about 4.5 weight percent carbon. Cast tungsten carbide commercially used as a matrix powder typically has a hypoeutectic carbon content of about 4 weight percent. In one embodiment of the present invention, the cast tungsten carbide used in the mixture of tungsten carbides is comprised of from about 3.7 to about 4.2 weight percent carbon.

Another type of tungsten carbide is macro-crystalline tungsten carbide. This material is essentially stoichiometric WC. Most of the macro-crystalline tungsten carbide is in the form of single crystals, but some bicrystals of WC may also form in larger particles. Single crystal monotungsten carbide is commercially available from Kennametal, Inc., Fallon, Nev.

Carburized carbide is yet another type of tungsten carbide. Carburized tungsten carbide is a product of the solid-state diffusion of carbon into tungsten metal at high temperatures in a protective atmosphere. Sometimes it is referred to as fully carburized tungsten carbide. Such carburized tungsten carbide grains usually are multi-crystalline, i.e., they are composed of WC agglomerates. The agglomerates form grains that are larger than the individual WC crystals. These large grains make it possible for a metal infiltrant or an infiltration binder to infiltrate a powder of such large grains. On the other hand, fine grain powders, e.g., grains less than 5 μm, do not infiltrate satisfactorily. Typical carburized tungsten carbide contains a minimum of 99.8% by weight of WC, with total carbon content in the range of about 6.08% to about 6.18% by weight.

Figure 10A:
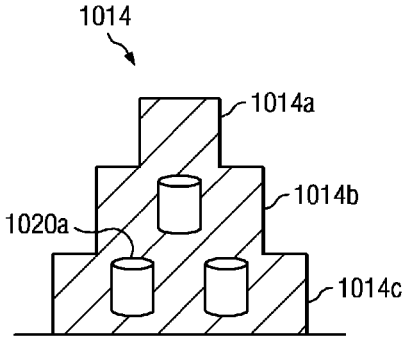
FIGS. 10A and 10B show cross-sectional views of ribs in accordance with embodiments of the present disclosure.
Figure 10B:
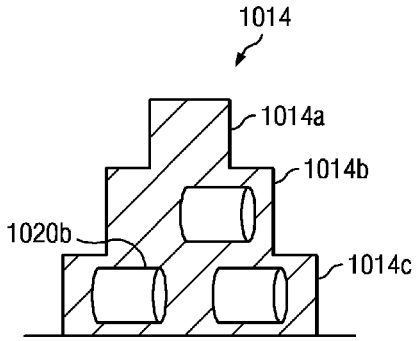

Further, referring to FIGS. 10A and 10B, any portion of a rib 1014 may be formed of preformed inserts 1020. For example, preformed inserts 1020*a* may be mounted within or positioned in a rib such that the inserts may be substantially perpendicular to the surface of the rib 1014 (at any point during drilling). As illustrated, rib 1014 includes steps 1014*a*, 1014*b*, and 1014*c*, where step 1014*b* and step 1014*c* include inserts 1020*a* embedded therein such that as steps 1014*b* and 1014*c* are subsequently reached, during drilling, inserts 1020*a* may become exposed to the surface. Further, alternatively, as shown in FIG. 10B, preformed inserts 1020*b* may be stacked within the rib, along its length, in a side by side fashion. Such preformed inserts may include a consolidated or hot pressed insert, such as the type described in U.S. Pat. No. 6,394,202, which is assigned to the present assignee and herein incorporated by reference in its entirety. Similar to other embodiments of impregnated ribs, such preformed inserts may include super abrasive particles dispersed within a continuous matrix material. Further, such preformed inserts may be formed from encapsulated particles, as described in U.S. Patent Publication No. 2006/0081402 and U.S. application Ser. Nos. 11/779,083, 11/779,104, and 11/937,969. Further, while FIGS. 10A and 10B show generally cylindrical preformed inserts, the present invention is not so limited. Rather, one skilled in the art would appreciate that preformed inserts of any geometry, whether symmetrical (including cylinders or cubes) or asymmetrical, may be used.

As discussed above, combinations of materials (and material properties) may be used in forming the ribs of the present disclosure. Thus various embodiments of the present disclosure may provide for a uniform or varied combination of materials through the steps or segments of a rib. In such embodiments where multiple combinations of materials are used in the various steps or segments of the rib(s), it is specifically within the scope of the present disclosure that materials may be selected to provide a differential in hardness/toughness, etc. For example, in a particular embodiment, a base of a rib may be formed of a harder material than the top height of the rib, while conversely in other embodiments, the base may be formed of a less hard or tougher material than the top height of the rib. Further, in an embodiment using vertical segments, it may be desirable to form exterior vertical segments of a softer material, as compared to interior segments, so as to provide for the in situ formation of a taper, as described above. Additionally, in embodiments using preformed inserts, it is within the scope of the present disclosure that inserts embedded in the rib structure may be formed of a first combination of materials while the surrounding rib material may be formed of a second combination of materials, where the rib materials may be uniform or varied through various steps or segments of the rib that may exist.

Manufacturing techniques may be used to form an infiltrated bit body of the present disclosure may begin with the fabrication of a mold, having the desired body shape and component configuration, including rib geometry. A mixture of matrix material and diamond (for example, in a clay-like mixture or as preformed inserts) may be loaded into the mold in the desired location. When multiple materials are used within different segments or layers of a bit, the materials may be placed in corresponding regions of a mold. The other segments or layers of the rib may be filled with a differing material, and the ribs may be infiltrated with a molten infiltration binder and cooled to form a bit body. Optionally, a matrix material, and optionally a metal binder powder, may be loaded on top of the materials forming the rib portions. In a particular embodiment, during infiltration a loaded matrix material may be carried down with the molten infiltrant to fill any gaps between the particles. Further, one skilled on the art would appreciate that other techniques such as casting may alternatively be used.

Several of the various techniques that may be used are now described, with reference to the above described bit structures described herein. For example, referring back to FIGS. 8A and 8B, a first material composition may be first loaded into a mold to correspond to step 814*a*, with a second (and third) material composition subsequently loaded thereon to fill the mold cavity corresponding to step 814*b* (and step 814*c*). Optionally, a thin metal divider may be used to separate the materials from each other. Use of such a metal sheet, such as copper, may be left in place during infiltration of the mold.

Further, referring back to FIG. 9, a thin plastic divider(s) (or divider of any suitable material such a copper, aluminum, or other metal sheet) may be placed in the mold dividing a rib into vertical segments. Either the portion of the mold corresponding to the various segments may then be filled with the component materials described above. In a particular embodiment, the materials (diamond and matrix powder) may be combined as premixed pastes which may then be packed into the mold in the respective portions of the mold. Depending on the type of materials used as the divider, the divider may be removed, or may be left in place if, for example, a copper sheet is used, and the bit may then be infiltrated with an infiltrating binder.

By using a paste-like mixture of superabrasives, carbides, and metal powders, the mixture may possess structural cohesiveness beneficial in forming a rib having the material make-up disclosed herein, such as described in U.S. patent application Ser. No. 12/121,504, filed on May 15, 2008, which assigned to the present assignee and herein incorporated by reference in its entirety. Additionally, the material may be formable or moldable, similar to clay, which may allow for the material to be shaped to have the desired thickness, shape, contour, etc., when placed or positioned in a mold. Further, as a result of the structural cohesiveness, when placed in a mold, the material may hold in place without encroaching the opposing portion of the mold cavity. Further, the material may be designed to possess a tackiness.

Referring back to FIGS. 10A and 10B, for example, such bit may be formed by stacking preformed inserts 1020 within a mold corresponding to the desired location. Optionally, an adhesive may be used to "stick" the inserts in the desired location of the mold while assembling remainder of mold. The remainder of the rib portion may then be "packed" with a premix of diamond and carbide paste, and infiltration may occur.

Advantageously, embodiments of the present disclosure for at least one of the following. Incorporation of a stepped or graded rib may provide for several potential performance advantages during drilling. For example, when a bit is new and begins drilling, better hydraulic flow from the center of the bit may be achieved. Further, the reduced contact area (and openness of the bit) may allow for better cleaning and cooling of the cutting structure as cuttings are better swept away, in addition to providing an initial high ROP due to the smaller contact area. In addition to providing a jump in ROP, the bit may also possess durability during the entire life of the bit. Further, a bit may more easily transition from one formation type into a second formation type, for example from a softer formation into a harder formation. Further, preformed inserts may be configured in a variety of positions to allow for tailoring to particular formation needs. Further, the layering of materials may provide for further improvements in ROP and bit durability.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A drill bit, comprising:

a body having a lower end face for engaging a rock formation, the end face having a plurality of raised ribs extending a height from the face of the body and separated by a plurality of channels therebetween;

wherein each of the plurality of ribs has a width measured between a leading surface and a trailing surface of the rib, wherein the leading surface faces in the direction of bit rotation and the trailing surface faces in a direction away from bit rotation;

wherein the width of at least a portion of at least one of the plurality of ribs varies along at least a portion of the height of the rib; and wherein a major volume of the at least one rib comprises super abrasive particles impregnated within a supporting material formed from at least two different impregnated materials, wherein the two different impregnated materials have at least a difference in hardness and/or diamond concentration.

2. The drill bit of claim 1, wherein the width varies gradually along the rib height.

3. The drill bit of claim 1, wherein the width varies incrementally along the rib height.

4. The drill bit of claim 1, wherein the width varies both gradually and incrementally along the rib height.

5. The drill bit of claim 1, wherein the at least one rib is divided into a plurality of horizontal layers, wherein at least two of the plurality of layers comprise different impregnated materials.

6. The drill bit of claim 5, wherein the horizontal layer proximate an outermost surface of the at least one rib has a hardness difference from the horizontal layer distal the outermost surface of the at least one rib in the range of from 7 HRC to 50 HRC, and wherein the horizontal layer distal the outermost surface of the at least one rib has a greater hardness value than the horizontal layer proximate the outermost surface of the at least one rib.

7. The drill bit of claim 1, wherein the at least one rib is divided into a plurality of vertical segments, wherein at least two of the plurality of segments comprise different impregnated materials.

8. The drill bit of claim 1, wherein the supporting material comprises a carbide-containing matrix material.

9. The drill bit of claim 1, wherein substantially all of the volume of each of the plurality of raised ribs comprises super abrasive particles impregnated within a matrix material.

10. The drill bit of claim 9, wherein each of the plurality of raised ribs has a major portion of the length of the leading surface that consists of impregnated material.

11. The drill bit of claim 1, wherein at least one of the plurality of ribs has a major portion of the length of the leading surface that consists of impregnated support material.

12. The drill bit of claim 11, wherein each of the plurality of ribs has a major portion of the length of the leading surface that consists of impregnated support material.

13. A drill bit, comprising:

a body having a lower end face for engaging a rock formation, the end face having a plurality of raised ribs extending a height from the face of the body to an outermost surface and separated by a plurality of channels therebetween;

wherein each of the plurality of ribs has a width measured between a leading surface and a trailing surface of the rib, wherein the leading surface faces in the direction of bit rotation and the trailing surface faces in a direction away from bit rotation;

wherein the width of at least a portion of at least one of the plurality of ribs varies along at least a portion of the height of the rib; and wherein the at least one rib comprises at least one preformed insert embedded under the outermost surface of the rib, wherein the preformed insert consists essentially of super abrasive particles dispersed within a matrix material.

14. A drill bit, comprising:

a body having a lower end face for engaging a rock formation, the end face having a plurality of raised ribs extending a height from the face of the body and separated by a plurality of channels therebetween;

wherein each of the plurality of ribs has a width measured between a leading surface and a trailing surface of the rib, wherein the leading surface faces in the direction of bit rotation and the trailing surface faces in a direction away from bit rotation;

wherein at least one of the leading surface and the trailing surface of at least one of the plurality of ribs has at least one step formed therein, such that the at least one step results in a width decrease along at least a portion of the height of the rib; and wherein a major volume of the at least one rib comprises super abrasive particles impregnated within a supporting material.

15. The drill bit of claim 14, wherein the at least one rib is divided into a plurality of layers corresponding to incremental changes in width.

16. The drill bit of claim 15, wherein at least two of the plurality of layers comprise different impregnated materials.

17. The drill bit of claim 14, wherein the at least one rib is divided into a plurality of vertical segments, wherein at least two of the plurality of segments comprise different impregnated materials.

18. The drill bit of claim 14, wherein the width of the at least one rib also varies gradually between each incremental change in width.

19. The drill bit of claim 14, wherein the at least one rib comprises at least one preformed insert therein.

20. The drill bit of claim 14, wherein substantially all of the volume of the at least one rib comprises a matrix material impregnated with super abrasive particles.

21. The drill bit of claim 14, wherein substantially all of the volume of each of the plurality of raised ribs comprises super abrasive particles impregnated within matrix material.

22. The drill bit of claim 21, wherein a major portion of the length of the leading surface of each of the plurality of raised ribs consists of impregnated material.

23. The drill bit of claim 14, wherein at least one of the stepped decreases in width has a width differential ranging from 0.05 inches to 0.75 inches.

24. The drill bit of claim 14, wherein the portion of rib having a stepped decrease in width comprises at least three stepped decreases in width.

25. The drill bit of claim 14, wherein at least one of the plurality of ribs has a major portion of the length of the leading surface that consists of impregnated support material.

26. The drill bit of claim 25, wherein each of the plurality of ribs has a major portion of the length of the leading surface that consists of impregnated support material.

27. The drill bit of claim 14, wherein the external surfaces of both the leading surface and the trailing surface of the rib have steps formed therein.

28. A drill bit, comprising:

a body having a lower end face for engaging a rock formation, the end face having a plurality of raised ribs extending a height from the face of the body and separated by a plurality of channels therebetween;

wherein each of the plurality of ribs has a width measured between a leading surface and a trailing surface of the rib, wherein the leading surface faces in the direction of bit rotation and the trailing surface faces in a direction away from bit rotation, and wherein the height is measured along a vertical centerline of the rib between a base and an outermost surface of the rib;

wherein at least a portion of at least one of the plurality of ribs has a gradual decrease in height from the vertical centerline along the width and a gradual decrease in width along the height of the rib, such that the portion has a parabolic cross-sectional geometric profile along a plane intersecting the width and the height of the rib; and wherein a major volume of the at least one rib comprises super abrasive particles impregnated within a supporting material.

29. The drill bit of claim 28, wherein the at least one rib is divided into a plurality of horizontal layers, wherein at least two of the plurality of layers comprise different impregnated materials.

30. The drill bit of claim 28, wherein the at least one rib comprises at least one preformed insert therein, wherein the preformed insert consists essentially of super abrasive particles dispersed within a matrix material.

31. The drill bit of claim 28, wherein the supporting material comprises a carbide-containing matrix material.

32. The drill bit of claim 28, wherein substantially all of the volume of each of the plurality of raised ribs comprises super abrasive particles impregnated within matrix material.

33. The drill bit of claim 32, wherein each of the plurality of raised ribs has a major portion of the length of the leading surface that consists of impregnated material.

34. The drill bit of claim 28, wherein at least one of the plurality of ribs has a major portion of the length of the leading surface that consists of impregnated support material.

* * * * *